United States Patent [19]

Sticksel

[11] Patent Number: 4,736,194

[45] Date of Patent: Apr. 5, 1988

[54] FENCE WITH SECURITY WIRES FASTENED TO POSTS VIA SENSORS

[75] Inventor: Manfred Sticksel, Alzenau, Fed. Rep. of Germany

[73] Assignee: KTV-Systemtechnik GmbH, Kleinostheim, Fed. Rep. of Germany

[21] Appl. No.: 792,920

[22] Filed: Oct. 30, 1985

[30] Foreign Application Priority Data

Jul. 4, 1985 [DE] Fed. Rep. of Germany ..... 3523872

[51] Int. Cl.[4] ..... G08B 13/00

[52] U.S. Cl. ..... 340/541; 340/518; 340/668

[58] Field of Search ..... 340/541, 564, 668, 518; 358/105, 108; 342/27–28; 367/93–94; 364/423

[56] References Cited

U.S. PATENT DOCUMENTS 4,124,848 11/1978 Clark et al. ..... 364/423 X
4,155,083 5/1979 Slaats et al. ..... 340/541 X
4,249,207 2/1981 Harman et al. ..... 358/108
4,367,459 1/1983 Amir et al. ..... 340/541
4,591,834 5/1986 Kyle ..... 340/518 X

FOREIGN PATENT DOCUMENTS 2413650 9/1975 Fed. Rep. of Germany ..... 340/564

*Primary Examiner*—Glen R. Swann, III
*Assistant Examiner*—Thomas J. Mullen, Jr.
*Attorney, Agent, or Firm*—Pascal & Associates

[57] ABSTRACT

A fence having security wires fastened to posts via sensors and having an electronic evaluation circuit connected to the sensors, which releases an alarm signal when one of the sensors signals a contact of the security wire which is connected to it. Each sensor has a housing fastened to a post, a holder connected to a security wire and a transformer placed between housing and holder, which produces a signal which is approximately proportional to the position of the holder. An alarm signal is generated when one or only a few security wires move slowly, yet such slow movements are ignored when caused by environmental factors. A highly reliable security fence is thus obtained.

12 Claims, 3 Drawing Sheets

FENCE WITH SECURITY WIRES FASTENED TO POSTS VIA SENSORS

Figure 1:
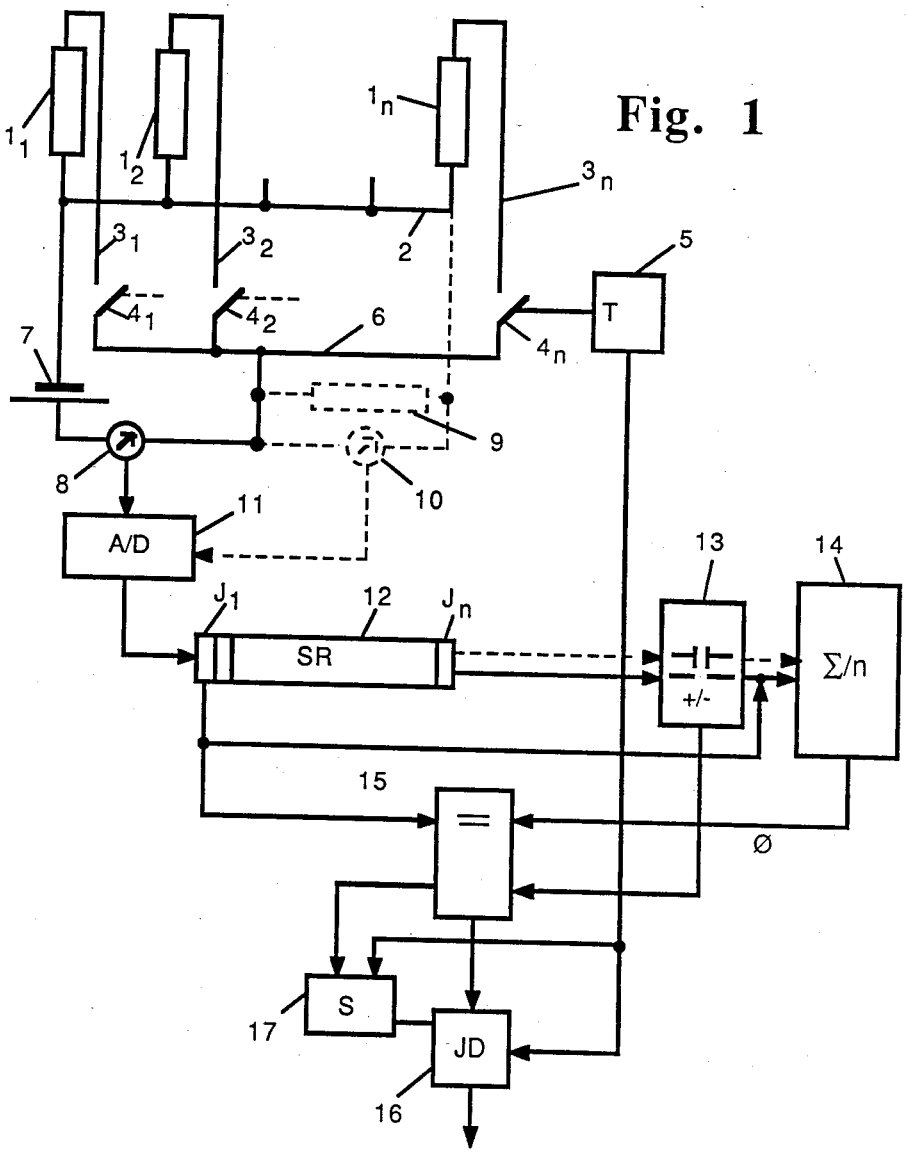

The invention relates to a fence having security wires fastened to posts via sensors and having an electronic evaluation circuit connected to the sensors, which releases an alarm signal when one of the sensors signals a contact of the security wire which is connected to it. Each sensor has a housing fastened to a post, a holder connected to a security wire and a transformer placed between housing and holding part, which produces a signal which is approximately proportional to the position of the holding part.

A fence of this type is described in German Offenlegungsschrift No. 25 42 544. With this fence, a piezo transformer acting as transmitter and a piezo transformer acting as receiver are attached to the ends of each security wire respectively. A power amplifier is interposed between the transmitter of a security wire and the receiver of an adjacent security wire in each case. An electronic evaluation circuit is attached between an amplifier and a receiver. Each transmitter causes its corresponding security wire to oscillate. A resultant oscillation occurs thereby from all security wires whose interference is detected by the electronic evaluation circuit. Such an interference occurs, for example, if one of the security wires is contacted and, as a result, its natural motion is disturbed.

This known fence has a number of disadvantages. Since a power amplifier is situated between each of the transmitters and receivers, a considerable wiring expenditure is required for supplying the power amplifier. However, the main disadvantage can be seen in that the numbers of false alarms are relatively high. With a gusty wind, for example, the frequency of the resultant oscillation can change considerably, which results in an alarm signal. The same is true if, for example, fallen twigs and branches from trees remain hanging in the fence and touch the security wires. Additional detunings of the oscillation loop result from extreme high and low temperatures, since the security wires considerably alter their length thereby and thus their natural frequency.

Moreover, fence systems are known whose sensors consist of switches. These switches are mounted in such a way that, with slow movements of the security wires, no contact making results, yet, this does occur when the security wire is moved quickly, which is the case when a person attempts to climb over the fence and comes in contact with a security wire. It is however disadvantageous that the extent of the motion of the security wire, from which a contact making occurs, can only be controlled with difficulty. In this case, the danger exists then that, with a gusty wind, a contact making occurs in some of the sensors and a false alarm is released. It is also possible to overcome this type of a fence if care is taken that only very slow movements are exerted on the security wires.

It is an object of this invention to provide a fence design such that an alarm signal results with slow movements of the security wires, when these slow movements occur only with one or a few security wires, yet, that such slow movements are ignored when they are caused by environmental influences.

Environmental influences refer here, for example, to changes in temperature and wind forces. It should be noted that such security fences can extend partially over open fields and partially in wooded areas.

Such environmental or atmospheric influences affect the signal amplitudes of the sensors. Since the signal amplitudes of the sensors are drawn up to a mean value formation, the environmental influences affect the size of the mean value. Signal amplitudes of sensors, which deviate considerably from the mean value, indicate, on the other hand, that additional movements, not caused by environmental influences, are carried out, which lead to a signalling and thus to the release of an alarm signal.

In general the invention is a fence with security wires fastened to posts via sensors, an electronic evaluation circuit connected to the sensors, for outputting an alarm signal when one of the sensors signals a contact of an associated security wire, each sensor having a housing connected to a post, a holder connected to the associated security wire, and a transformer connected between the housing and holder which produces a signal approximately proportional to the position of the holder. The evaluation circuit is comprised of a switch system which connects individual ones of the sensors in series with a measurement system, the measurement system measuring the signal amplitude generated by each sensor in a scanning cycle. The measured signal amplitudes are transmitted to a circuit for forming a mean value and a comparator circuit for comparing the signal amplitude of each sensor with the mean value and for outputting the alarm signal when the difference between signal amplitude and mean value exceeds or falls below a first threshold.

Figure 2:
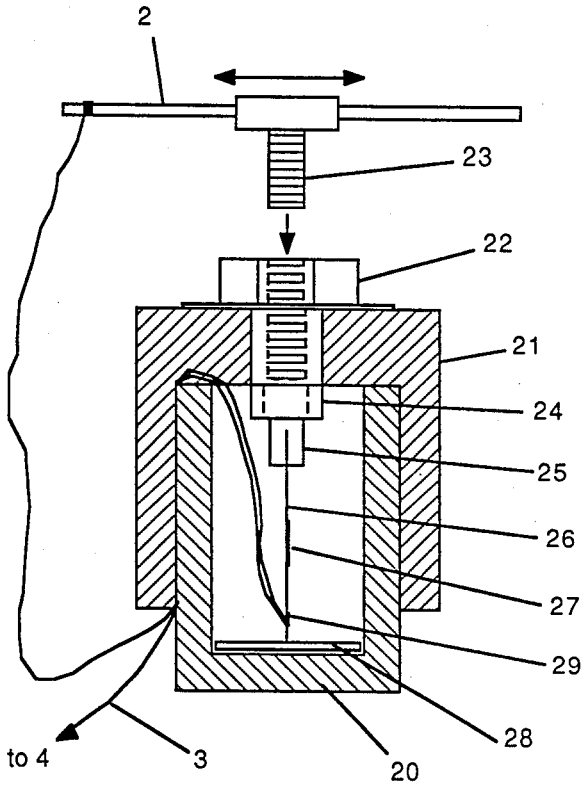
Figure 3:
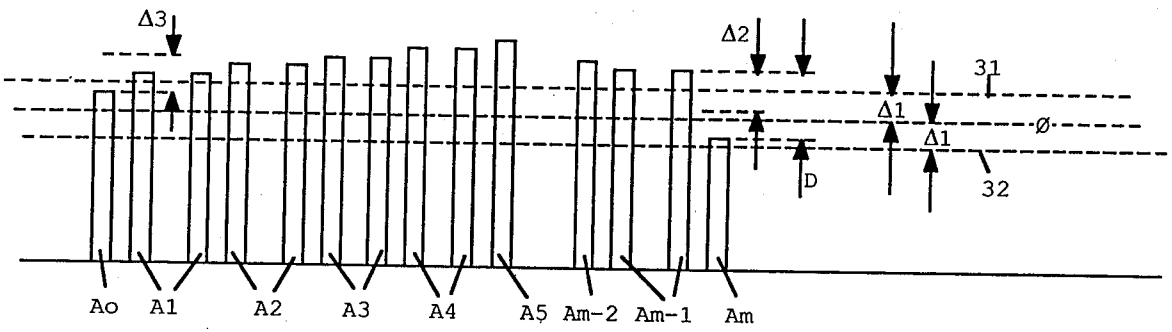
Figure 4:
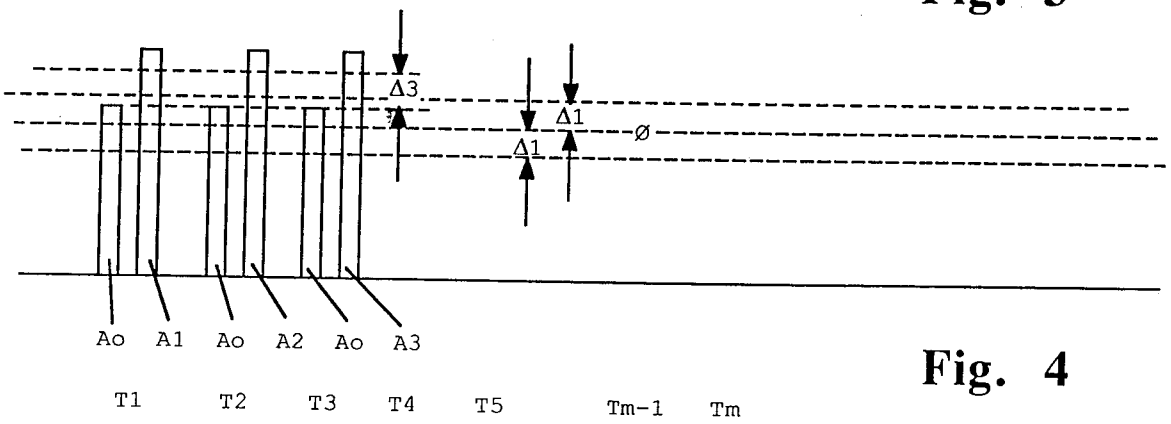

Embodiments of the invention are described in greater detail in the following with reference to the drawings, showing:

FIG. 1 is a block diagram of an evaluation circuit with the sensors connected with it, FIG. 2 is a section through a sensor, in which a transformer consists of a wire strain gauge, and FIGS. 3 and 4 are signal level examples occurring during various scanning periods.

The transformers $\mathbf{1}_1$, $\mathbf{1}_2 \ldots \mathbf{1}_n$ of all or one group of sensors of the fence are electrically connected, on the one hand, to a common lead 2. This common lead 2 is formed by the security wires, which are electrically connected to one another. Each of the other ends of the transformers 1 are connected to the evaluation circuit via separate leads $\mathbf{3}_1$, $\mathbf{3}_2 \ldots \mathbf{3}_n$. A switch $\mathbf{4}_1$, $\mathbf{4}_2 \ldots \mathbf{4}_n$ is connected in series with each lead 3 in the evaluation circuit. In this case, they are electronic switches which are closed and opened in succession, which is controlled by a pulse generator 5. Therefore, at first the switch $\mathbf{4}_1$, then switch $\mathbf{4}_2$ etc., and finally switch $\mathbf{4}_n$ and then again switch $\mathbf{4}_1$ is closed by the pulse generator. One side of the switches 4 are connected to common lead 6. If the transformers 1 are wire strain gauges, then a source of current 7 and, in series therewith, a measurement system 8 are connected between the leads 2 and 6.

If the transformers 1 are piezoxide transformers, then a high resistance 9 and, in parallel to it, a measurement system 10 are connected between the leads 2 and 6. In this case, the battery 7 and the measurement system 8 are no longer required.

The output of the measurement system 8 or 10 is connected to the input of an analog-to-digital converter 11. Its output is connected to the input of a shift register 12. This shift register 12 has as many individual accumulators $s_1 \ldots s_n$ as transformers 1 attached to the evaluation circuit. The output of the last accumulator $s_n$ of the shift register 12 is connected to an intermediate accumulator 13. This intermediate accumulator 13 is, in turn, connected to a sum accumulator 14, which carries out the determination of the mean value. The input accumulator $s_1$ of the shift register and the output of the sum accumulator 14, which determines the mean value, are connected to a comparator circuit 15. Moreover, the intermediate accumulator 13 can be connected to this comparator circuit 15. The output of this comparator 15 is connected to an identification system 16, to which the impulse generator 5 is also connected. A further output of the comparator circuit 15 can be connected to a decision circuit 17, to which pulses from the pulse generator 5 are also transmitted. This output is then also connected to the identification system 16.

As a result of the successive closing and opening of the switches 4, their signals are measured in the measurement system 8 or 10. If the transformers 1 are wire strain gauges, then their respective resistance value is determined by a current measurement in the measurement system 8. If these are peizoxide transformers, then their respective voltage is determined by the measurement system 10. Every determined signal amplitude is digitized and entered into the input accumulator $s_1$, the value in the output accumulator $s_n$ is given out into the intermediate accumulator 13. The value of the signal amplitude entered into the input accumulator $s_1$ originates from the same transformer 1 as the value of the signal amplitude, which was determined in the preceding cycle of the operation of the switches 4, emitted from the output accumulator $s_n$. If, therefore, for example, switch $4_2$ is closed and, as a result, the signal amplitude of the transformer $1_2$ fed into the accumulator $s_1$, then the value of the signal amplitude which was determined by the transformer $1_2$ during the preceding scanning cycle during operation of switch $4_2$ is emitted by the output accumulator $s_n$ and fed into the intermediate accumulator 13.

In the sum accumulator 14, the signal amplitude value stored in the intermediate accumulator 13 and emitted by the output accumulator $s_n$ is subtracted from the sum $\epsilon$ stored in the accumulator 14, whereas the signal amplitude value re-entered into the input accumulator $s_1$ is added to the sum stored in the sum accumulator 14. The initial sum which is stored in the sum accumulator 14 is maintained after starting the evaluation circuit during the first cycle of operating the switches 4, in that the signal amplitude values of all transformers 1 are entered into the sum accumulator 14 in succession, while the connection between the output accumulator $s_n$ and the sum accumulator 14 is interrupted. By means of the above-described procedure, the sum of all signal amplitude values of the transformers 1 stored in the sum accumulator 14 are updated. If the sum accumulator 14 only has one input, then the intermediate accumulator 13 is combined with an inverter, which converts the value emitted by the output accumulator $s_n$ to a negative value. If the sum accumulator 14 has an upward and a downward shift input, then the intermediate accumulator 13 is connected with the downward shift input and the input accumulator $s_1$ with the upward shift input.

The sum accumulator 14 is combined with a divider which divides the sum $\epsilon$ of all signal amplitudes by the number n of all transformers $1_1 \ldots 1_n$. At the output of the sum accumulator 14, a constantly actualized mean value $\phi$ of all signal amplitudes results, which is applied to the comparator circuit 15. Moreover, the signal amplitude value, ascertained in each case and entered into the input accumulator $s_1$, is transmitted to this comparator circuit 15. This signal amplitude value is compared with the mean value. If this mean value is exceeded or has fallen below by a first threshold, an alarm signal is produced which is transmitted to the identification system. As the identification system is connected to the pulse generator 5, it can determine at which transformer 1 and upon the operation of the corresponding switch 4, a too high or too low signal amplitude was located. The identification system 16 can, thus, show by which security wire the alarm signal was released.

It is possible that the transformer of a sensor has a too high or too low signal amplitude, which exceeds or falls below the first threshold range, due to environmental influences (that is, not as a result of contact with a security wire), if, for example, the corresponding security wire is subjected to complete exposure to the rays of the sun while the other security wires are in the shade. Thus, it is preferred that the alarm signal produced by the comparator 15 is not directly passed on to the identification system 16. On the contrary, this alarm signal causes the value stored in the intermediate accumulator 13 to also be stored in the comparator 15 when the alarm signal occurs. This storage value is compared with the newly produced signal amplitude of the same transformer 1 during the following scanning period and the result is transmitted to the decision circuit 17. With each scanning cycle, therefore, a comparison is carried out in the comparator 17 between the newly produced signal amplitude (transmitted from $s_1$) and the signal amplitude produced in the preceding scanning cycle (transmitted from 13) of the same sensor 1 in each case, as long as these signal amplitudes exceed or fall below the mean value by the first threshold. Not until this decision circuit detects a sudden change of the difference (second threshold) between the respective storage value (transmitted from 13) and each of the newly produced signal amplitudes (transmitted from $s_1$) is the alarm signal transmitted to the identification system (16) (see FIG. 3).

One proceeds in a similar manner if accumulations of snow falling from the fence strike a security wire, as a result of which the transformer of the allotted sensor has a too high or too low signal amplitude. In this case also, the alarm signal is not directly transmitted to the identification system 16, but, instead, serves to store the value stored in the intermediate accumulator 13, which is compared with each of the newly produced signal amplitudes of the same transformer during the following two or three scanning periods. It is now ascertained whether the difference between the stored value and each of the newly produced signal amplitudes exceeds a third threshold. The result of this comparison is also transmitted to the decision circuit 17, which passes the alarm signal on to the identification system 16, if, during these two or three scanning periods, the signal amplitude of this transformer does not return to the original value called by the intermediate accumulator 13 (see FIG. 4), provided that the previously described case (see FIG. 3) is not registered.

The sensor shown in FIG. 2 has a cup-shaped, cylindrical housing 20 which consists of synthetic material and which is firmly mounted on a post of the fence. The open end of the housing is covered over by a sleeve 21, also cylindrical and cup-shaped, which consists of a soft elastic material such as, for example, rubber. A boltshaped holder 22 passes through this sleeve 21, the holder 22 having a flange-type head and an inner bore. A screw 23, which is firmly connected to the security wire 2, can be screwed into this inner bore. This security wire is extended between two additional posts by means of a spring. A nut can be screwed on to the inner extension 24 of the holder. On the inside, the holder has a bolt 25 which is provided with a cut. A flat bronze spring 26, which has a wire strain gauge 27, is inserted in this cut and is soldered to the bolt 25. The lower end of the wire strain gauge is inserted into the slot of a metal disk 28 and is soldered to the metal disk, whose outside diameter corresponds approximately to the inner diameter of the housing 20. The ends of the wire strain gauge extend to a connection plate 29, from which the connections between sleeve and housing are led outward. One of the leads is connected to the security wire 2, whereas the other lead 3 leads to a switch 4 of the electronic evaluation circuit.

Instead of a spring 26 with wire strain gauge 27, a piezoxide transformer or a Hall effect generator can also be provided, whereby, in the latter case, a permanent magnet is also placed in the housing 20.

FIGS. 3 and 4 illustrate the comparisons of the signal amplitudes carried out by the comparator 13. These comparisons are conducted in successive scanning periods to the scanning periods $T_1, T_2 \ldots T_m$. In each case, it deals with signals of the same sensor 1, whose signal $A_1$, registered at a scanning period $T_1$, has an amplitude which exceeds the mean value $\phi$ by the first threshold $\Delta_1$. Exceeding the upper threshold value limit 31 represents the first test criterion. The following description of FIGS. 3 and 4 also applies analogously in the event that the signal $A_1$, registered at the scanning period $T_1$, falls below the lower threshold limit 32.

If this first test criterion is positive, then the signal $A_0$, registered in the preceding scanning period, is transmitted from the accumulator 13 to the comparator 15.

If the difference between the amplitudes of the signals $A_0$ and $A_1$ is smaller than the third threshold $\Delta_3$, then one proceeds in accordance with FIG. 3. If, however, the difference is greater than the third threshold $\Delta_3$, then one proceeds in accordance with FIG. 4 (second test criterion).

In accordance with FIG. 3, at each scanning period T, the signal amplitude received at this scanning period is compared with the signal amplitude received in the preceding scanning period. This, therefore, means that, at the scanning period $T_5$, the signal amplitude $A_5$ scanned at this period is compared with the signal amplitude $A_4$ received at the period $T_4$. As soon as, at a period $T_m$, the difference D between the signal amplitude $A_m$, produced at this interval and the previously produced signal amplitude $A_{m-1}$ exceeds the second threshold $\Delta_2$, the alarm signal, which was produced at the period $T_1$, is now transmitted to the identification system 16 and the alarm is produced.

The case illustrated in FIG. 3 occurs if, for example, the security wire, which is connected to the sensor, whose signals are shown in FIG. 3, is subjected to the rays of the sun, so that the signals of this sensor exceed the upper threshold value limit 31, whereas the remaining security wires are in the shade. At the period $T_m$, a sudden change occurs between the signals of successive scanning periods, which means that a contact of the security wire has taken place. The alarm system, therefore, does not react to changes of the signals caused by the environment and taking place slowly, even if those signals exceed or fall below the upper or lower threshold value limit 31, 32. However, a signal is immediately released if an irregular change, for example, as a result of a contact of the security wire occurs.

If, in accordance with the second test criterion, it were ascertained at the moment $T_1$ that the difference of the signal amplitudes between the signals $A_1$ and $A_0$ exceeds the third threshold $\Delta_3$, then, during the two subsequent scanning periods $T_2$ and $T_3$, it is ascertained whether this condition is maintained at the scanning periods $T_2$ and $T_3$. If this is the case, then, at the period $T_3$, an alarm signal is transmitted from the comparator 15 to the identification system 16 and an alarm is released. If, however, the amplitude of the signal $A_3$ at the period $T_3$ again assumes approximately the amplitude of the signal $A_0$, then the alarm signal produced at the moment $T_1$ is prevented from being transmitted to the identification system 16. The length of time between the periods $T_1$ and $T_3$ is less than a second. This means that short-term signal variations which are caused by the environment, for example, as a result of the falling of snow accumulations, do not release a signal. However, the contacting of a security wire when the fence is being climbed produces a signal.

I claim:

1. An intrusion detection system comprising:

a fence with security wires fastened to posts via sensors, each sensor including a transducer for generating a signal approximately proportional to the tension in an associated wire, an electronic detection circuit to which the transducers are connected and which comprises:

a switching system which connects the transducers in sequence in a scanning cycle to a detector to detect the signal amplitude generated by each transducer, a circuit for generating a mean value of the signal amplitudes detected within a scanning cycle, a comparator for comparing the signal amplitude of each transducer with the mean value and for presetting an alarm signal when the difference between a signal amplitude and the mean value exceeds a first threshold, an identification circuit to identify transducers which generate signal amplitudes for which an alarm signal was preset, said comparator including means for comparing said signal amplitudes of each identified transducer for which an alarm signal was preset with the signal amplitude of said each identified transducer of the preceding scanning cycle and for generating an alarm signal when the difference between the compared signal amplitudes exceeds a second threshold.

2. A system according to claim 1, in which the circuit for generating the mean value is comprised of a sum accumulator for accumulating the signal amplitudes during said scanning cycle and dividing the accumulated signal amplitude by the number of transducers connected during a scanning cycle thereby generating the mean value.

3. A system according to claim 1 further comprising a shift register having an input connected to the detector and to the circuit for generating the mean value, an output connected to the circuit generating the mean value, and having registers corresponding to the number of transducers connected during a scanning cycle, whereby, during each scan of a scanning cycle the signal entered into said input increases the mean value and the signal output by said output decreases the mean value in the circuit generating the mean value.

4. A system according to claim 3, further comprising a store connected between the output of the shift register and the circuit generating the mean value for storing the signal output by the output register for a short time and then applying it to a sum accumulator and when an alarm signal is preset by the comparator then for applying it to the comparator.

5. A system according to claim 3, in which the input of the shift register is connected to the comparator circuit and the signal applied to the input of the shift register is simultaneously applied to the comparator.

6. A system according to claim 3, in which a signal entered into the input of the shift register when an alarm signal is preset is continuously compared in the comparator with the signal output from the output of the shift register.

7. A system according to claim 6, in which, if the difference between the entered and the output signal does not exceed a second threshold at the time that the alarm signal is preset, in each subsequent scanning cycle the signals of the identified transducer entered into the input of the shift register are compared with the signals output from the output of the shift register and the comparator outputs the alarm signal for generating the alarm when, during a scanning cycle, the difference between the compared signals exceeds a third threshold.

8. A system according to claim 6, in which, if the difference between the entered and the output signal exceeds a second threshold at the time when the alarm signal is preset, the signal output from the output register is compared, over a plurality of scanning periods, with the signals of the identified transducer entered into the input register, and the comparator outputs the alarm signal for generating the alarm, when the difference between the compared signals exceeds the second threshold for the duration of said scanning periods.

9. A system according to claim 6, in which a decision circuit is connected between the comparator and the identification circuit for identifying the transducer presetting the alarm signal, the decision circuit evaluating the comparison between the signal amplitudes in the scanning cycles following the presetting of the alarm signal and controlling the storage and outputting of the alarm signal for generating the alarm.

10. A system according to claim 3, in which an inverter is connected between the output of the shift register and the input of the circuit generating the mean value to which the input of the shift register is connected, said inverter causing a sign reversal of the signal output by said output of the shift register and applied to the circuit generating the mean value.

11. A system according to claim 1, in which the alarm signal preset by the comparator is transmitted to an identification circuit which is connected to a pulse generator, controlling the actuation of the switching system, the alarm signal identifying the transducer which presets the alarm signal.

12. A system according to claim 1, in which the generation of the mean value results from groups of sensors of the fence, each sensor of a group being associated with a security wire of a group of security wires which are subjected to similar environmental or atmospheric influences.

* * * * *